US006459880B1

(12) United States Patent
Russell

(10) Patent No.: US 6,459,880 B1
(45) Date of Patent: Oct. 1, 2002

(54) DOCUMENT CREATING SYSTEM INCLUDING A FILM FOR BONDING THE DOCUMENT TOGETHER

(75) Inventor: Robert David Russell, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 42 days.

(21) Appl. No.: 09/723,683

(22) Filed: Nov. 28, 2000

(51) Int. Cl.[7] ..... G03G 15/00
(52) U.S. Cl. ..... 399/408; 270/58.08; 399/409
(58) Field of Search ..... 399/408, 409; 270/52.18, 58.07, 58.08

(56) References Cited

U.S. PATENT DOCUMENTS

| | | | | | |
|---|---|---|---|---|---|
| 3,793,016 | A | * | 2/1974 | Eichorn | 399/408 |
| 4,129,471 | A | | 12/1978 | Rome | 156/211 |
| 4,149,288 | A | | 4/1979 | Sendor et al. | 11/1 AD |
| 4,611,741 | A | | 9/1986 | Wilson | 227/99 |
| 4,687,191 | A | | 8/1987 | Stemmle | 270/53 |
| 5,094,379 | A | | 3/1992 | Hoyer et al. | 227/2 |
| 5,531,429 | A | * | 7/1996 | Clark | 399/408 X |
| 5,595,336 | A | | 1/1997 | Everdyke | 227/7 |
| 5,842,624 | A | | 12/1998 | Ishida | 227/111 |
| 5,927,189 | A | | 7/1999 | Jones et al. | 101/23 |

* cited by examiner

*Primary Examiner*—William J. Royer
(74) *Attorney, Agent, or Firm*—Perman & Green, LLP

(57) ABSTRACT

A document creating apparatus comprising a transport system for transporting documents and an image transfer system for transferring images onto them. A film depositor is provided for depositing a film on at least one of the documents sheets. At least two of the document sheets are placed against each other with the film located between them. The document sheets are attached to each other by the film.

36 Claims, 8 Drawing Sheets

DOCUMENT CREATING SYSTEM INCLUDING A FILM FOR BONDING THE DOCUMENT TOGETHER

BACKGROUND OF THE INVENTION

1. Field of the Invention

The present invention relates to documents having two or more document sheets and, more particularly, to a method and apparatus for attaching document sheets to each other in order to form a bound document set.

2. Prior Art

Printers and Xerographic Copiers use electrically powered staplers at their output for attaching document sheets to each other with staples in order to form a bound document set. Such staplers are well known as noted in U.S. Pat. No. 5,094,379. U.S. Pat. No. 4,611,741 discloses an apparatus from a copier/duplicator which has a first and second adhesive binder and a first and second stapler/finisher. The use of staples for document sets adds thickness at the corner or edge of each set which becomes a problem when large numbers of document sets are stacked. Additionally, the mechanism associated with the stapler and staple feed has numerous moving parts as a potential source of failure.

SUMMARY OF THE INVENTION

In accordance with one embodiment of the present invention, a document creating apparatus is provided for creating at least one document comprising at least two document sheets. The document creating apparatus comprises a transport system for transporting the document sheets; an image transfer system for transferring images onto sheets of material to form the document sheets; and a film depositor for depositing a film at a film location on at least one of the document sheets. Two of the document sheets are placed against each other with the film located directly therebetween and are fixedly attached to each other by the film at the film location.

In accordance with another embodiment of the present invention, a bound document set is provided comprising a plurality of document sheets; and a film deposited at a film location on at least one of the document sheets. The film forms a bond at the film location between two of the document sheets.

In accordance with another embodiment of the present invention, a film dispensing supply is provided comprising a carrier strip; and a plurality of film patches located on the carrier strip. The film patches can be, at least partially, transferred to a first document sheet to form a bond between the first document sheet and a second document sheet.

In accordance with one method of the present invention, a method of attaching at least two document sheets to each other comprising the steps of depositing a film on a first one of the document sheets at a film location; placing a second one of the document sheets adjacent to the first document sheet; and bonding the first document sheet to the second document sheet at the film location by the film.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
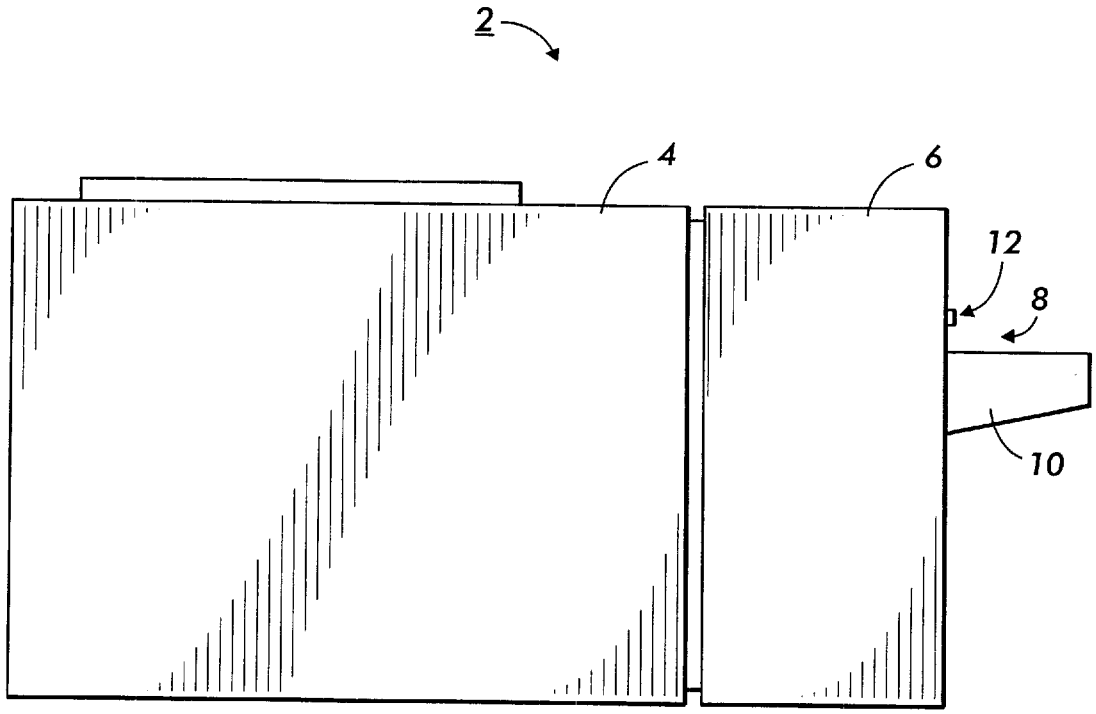
FIG. 1 is a schematic view of a document creating apparatus.

Referring to FIG. 1, there is shown, in schematic form, a view of a document creating apparatus 2 for creating documents in accordance with teachings of the present invention. Although the present invention will be described with reference to the single embodiment shown in the drawings, it should be understood that the present invention may be embodied in many alternate forms of embodiments. In addition, any suitable size, shape or type of elements or materials could be used. A copying or printing system of the type shown may be adapted to provide duplex or simplex stacked document sets from duplex or simplex collated document or print sets which result from either duplex or simplex original documents or output document computer files for print.

Document creating apparatus 2, in the embodiment shown, is a copier. However, in an alternate embodiment, the apparatus could be a printer or any other suitable type of document creating apparatus. Document creating apparatus 2 generally comprises a xerographic processing or printing section 4, a finishing section 6 and an output section 8. Printing section 4 can be an electrostatographic printing system such as made by Xerox Corporation or alternately other xerographic or other type of printing apparatus. Printing section 4 incorporates an image transfer system and a transport system for transporting sheets of material. Finishing section 6 may incorporate a hole punch, a stapler, a film dispenser, a bin sorter or a document bonder. Output section 8 incorporates a tray 10 that accepts and stacks documents or document sets output from finishing section 6 at output zone 12. Documents are printed or copied in printing section 4 and output from printing section 4 to finishing section 6. Documents are then sorted and bound at finishing section 6. Document sets are then output from finishing section 6 at output zone 12.

Figure 2:
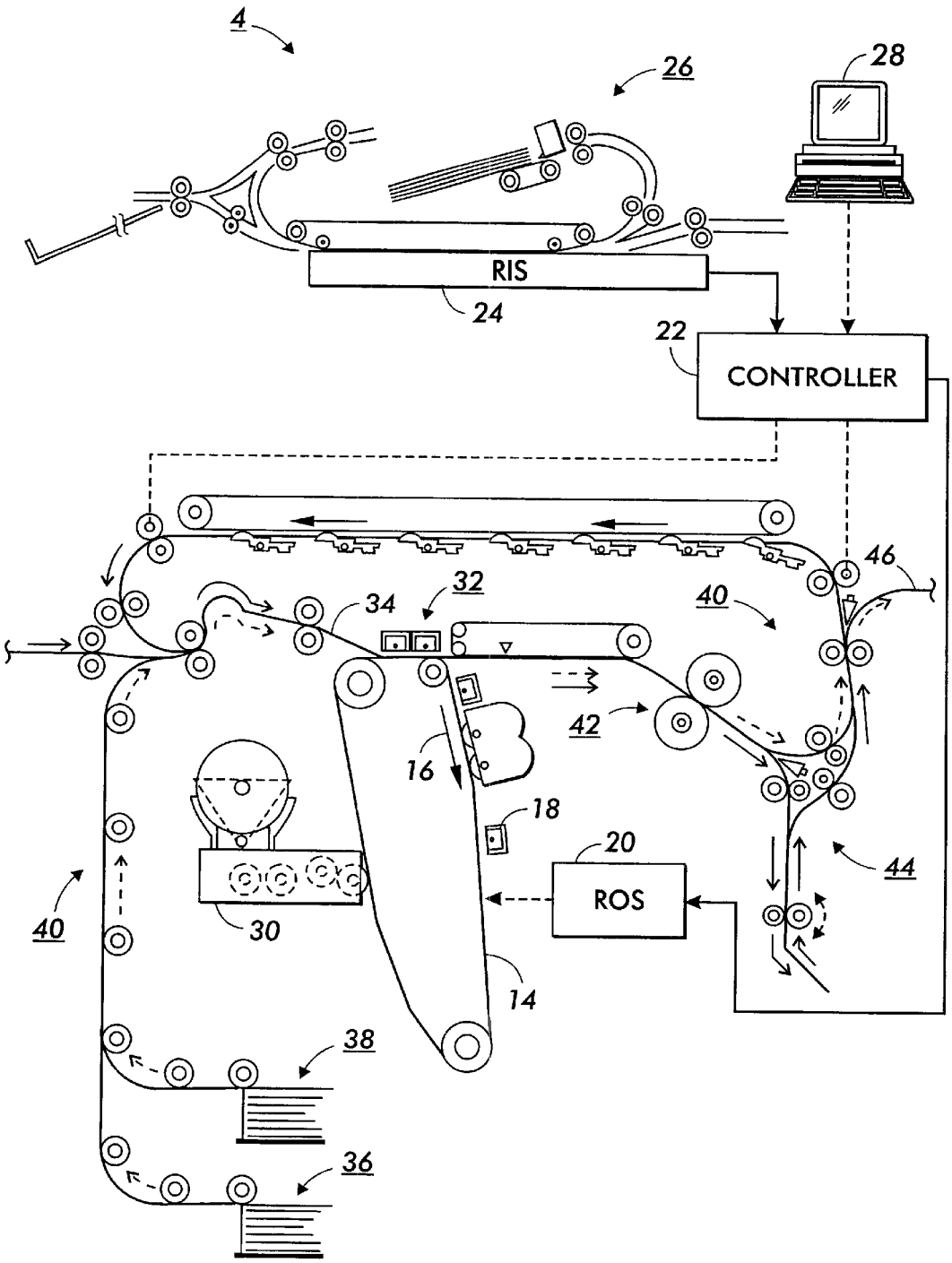
FIG. 2 is a schematic side view of a xerographic processing or printing section.

Referring also to FIG. 2, there is shown a schematic side view of one embodiment of the xerographic processing or printing section 4. The printing section 4 has a photoconductive belt 14 that advances in the direction of arrow 16. Photoconductive belt 14 passes through charging station 18 and exposure station 20 which is typically a raster output scanner that transmits a latent image from controller 22 onto the photoconductive surface of photoconductive belt 14. Controller 22 gets the image from raster input scanner 24 that typically incorporates a CCD and scans an image from document handler 26. Alternately, controller 22 gets the image from a separate computer 28 when printing section 4 operates as a printing device. Photoconductive belt 14 then advances to development station 30 where toner is electrostatically attracted to the latent image. Photoconductive belt 14 then advances to image transfer station 32. A sheet of material 34 is advanced from sheet stack 36 or sheet stack 38 by a sheet transport system 40. Sheet 34 is advanced to image transfer station 32 in a timed fashion.

The toner deposited on the latent image of photoconductive belt 14 is transferred to sheet 34 due to sheet 34 becoming charged at image transfer station 32 and due to sheet 34 being registered or timed relative to the latent image. Sheet 34 is then advanced to fusing station 42 where the toner image is permanently affixed to sheet 34, typically by heating, thus creating a document sheet. Sheet 34 will either be output to a finisher or a stacker or inverted at inverter 44 and recirculated through the printing section to have a second image deposited on its opposite side. After the image has been transferred, sheet 34 advances to finishing section 6 at exit 46. Although the section 4 of the apparatus 2 has been described in detail above, features of the present invention could be used with other types of xerographic processing or printing sections having any suitably blank paper or sheet supply, created document output, image transfer system or paper path. The description above is merely intended to be exemplary. More or less features could also be provided.

Figure 3:
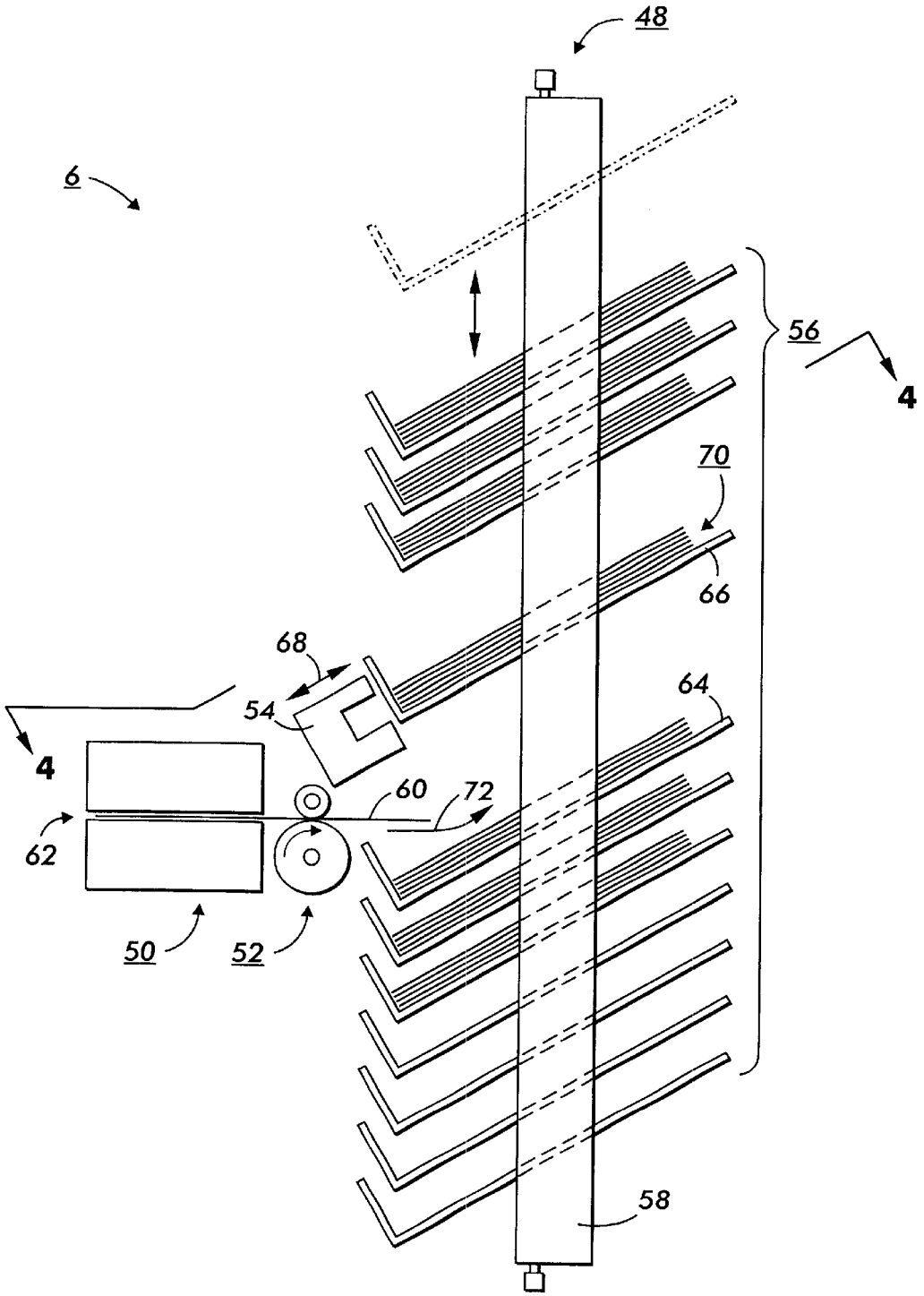
FIG. 3 is a schematic side view of a finishing section.
Figure 4:
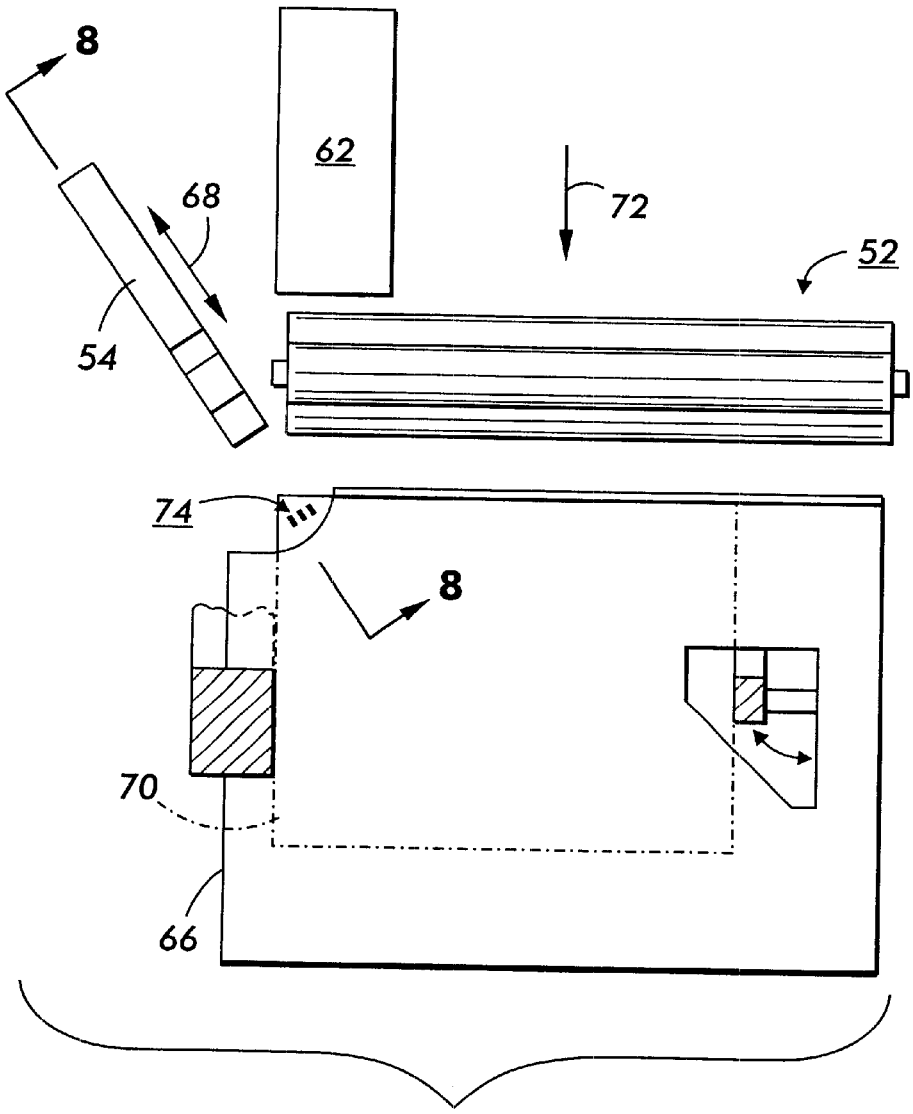
FIG. 4 is a schematic section inclined view of a finishing section.

Referring now also to FIGS. 3 and 4 there is shown a schematic side view of finishing section 6 and a schematic sectional view of the finishing section 6 taken along line x—x of FIG. 3. Finishing section 6 has a nested bin sorter 48, a film depositor 50, feed rollers 52 and document bonder 54. Bin sorter 48 comprises a plurality of bins 56 and an indexer 58 that individually vertically translates the bins 56. Bin sorter 48 may be any suitable type of sorter, such as shown in U.S. Pat. No. 4,687,191, for example, which is hereby incorporated by reference in its entirety. Sheet 60 enters finishing section 6 along paper path 72 from exit 46 of the xerographic processing or printing section 4 at entry 62. Film depositor 50 deposits a film at one or a plurality of film locations on sheet 60. Film depositor 50 is capable of depositing or dispensing a film such as toner, thermoplastic resin, polypropylene, polycarbonate, styrene, acrylic, polyethylene, adhesive or other types of film suitable for binding sheets together to form a document set. Film depositor 50 may selectively deposit a film on none, one, or both sides of sheet 60. After passing through film depositor 50, sheet 60 is transferred to the location indicated by the bin referenced 64 of bin sorter 48 through feed rollers 52. Feed rollers 52 may alternately be incorporated in film depositor 50. A plurality of bins 56 are successively indexed up or down as required and successive sheets are deposited in the bins as herein described until all the document sheets in the set have been stacked. Indexer 58 is arranged to cause each bin to dwell at a bonding location indicated by the location of bin referenced 66 of bin sorter 48. Aligned with the location of the bin referenced 66 is document bonder 54 that is positioned so that when it is reciprocated in direction 68 from its usual rest position, the bonder 54 is able to bracket a completed set of document sheets. Bonder 54 can be reciprocated by any conventional means such as, a gear and rotatable shaft driven by a motor or moved by a cam attached to a motor and returned to its rest position by means of a spring. When bonder 54 has reached its inner operating position, it is able to be actuated to bond a document set 70 with pressure or heat applied at the film location corresponding to the film deposited by film depositor 50 at one or a plurality of film locations on the sheets as denoted by film location 74.

Although the section 6 of the apparatus 2 has been described in detail above, features of the present invention could be used with other types of xerographic processing or printing sections having any suitably blank paper or sheet supply, created document output, or image transfer system. The description above is merely intended to be exemplary. More or less features could also be provided. Although film depositor 50 is shown at a fixed position within the copying or printing apparatus, this position is intended to be exemplary and various alternative locations and modifications can be devised by those skilled in the art without departing from the invention. Such an alternative location for example could be incorporating film depositor 50 into xerographic processing or printing section 4. Such an alternative modification for example could be incorporating film depositor 50 into xerographic processing or printing section 4 by utilizing the image transfer system and transport system of xerographic processing or printing section 4 to deposit a film at one or a plurality of film locations on the sheets. Although bonder 54 is shown at a position within the copying or printing apparatus, this position is intended to be exemplary and various alternative locations and modifications can be devised by those skilled in the art without departing from the invention. Such an alternative, for example, would be locating bonder 54 within each of the plurality of trays or locating bonder 54 and indexing the sets of document sheets to bonder 54 individually.

Figure 5:
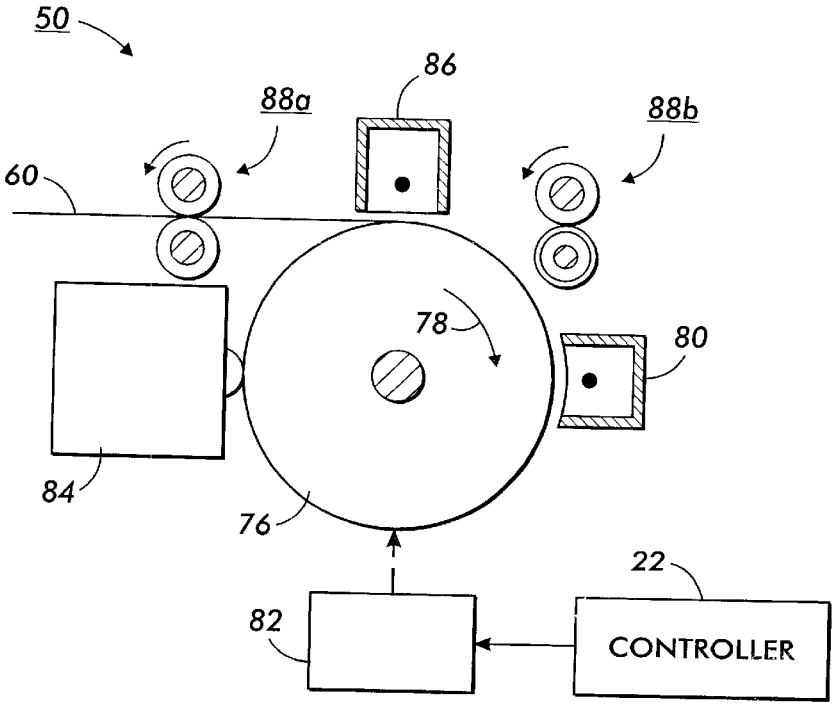
FIG. 5 is a schematic side view of a film depositor.

Referring now also to FIG. 5, there is shown a schematic side view of film depositor 50 according to one embodiment of the present invention. Film depositor 50 has a photoconductive drum or belt 76 that advances in the direction of arrow 78. Drum 76 passes charging station 80 and exposure station 82 that transmits a latent film image from controller 22 onto drum 76. The latent film image on drum 76 then advances to development station 84 where toner is electrostatically attracted to the latent film image. Drum 76 then advances to film image transfer station 86. Sheet of material 60 is advanced by a sheet transport system **88*a* to film image transfer station 32 in a timed fashion. The toner deposited on the latent film image of drum 76 is transferred to sheet 60 at one or a plurality of film locations. This is due to sheet 60 becoming charged at film image transfer station 86 and due to sheet 60 being registered or timed relative to the latent film image such that the latent film image is transferred to the desired film location(s). Sheet 60 is then advanced by a sheet transport system 88*b* to be stacked in a bin or a bin sorter prior to a bonding operation. The description above is merely intended to be exemplary. More or less features, alternatives and modifications can be devised by those skilled in the art without departing from the invention. For example, any type of printing apparatus capable of printing a film as herein described may be used as film depositor 50**.

Figure 6:
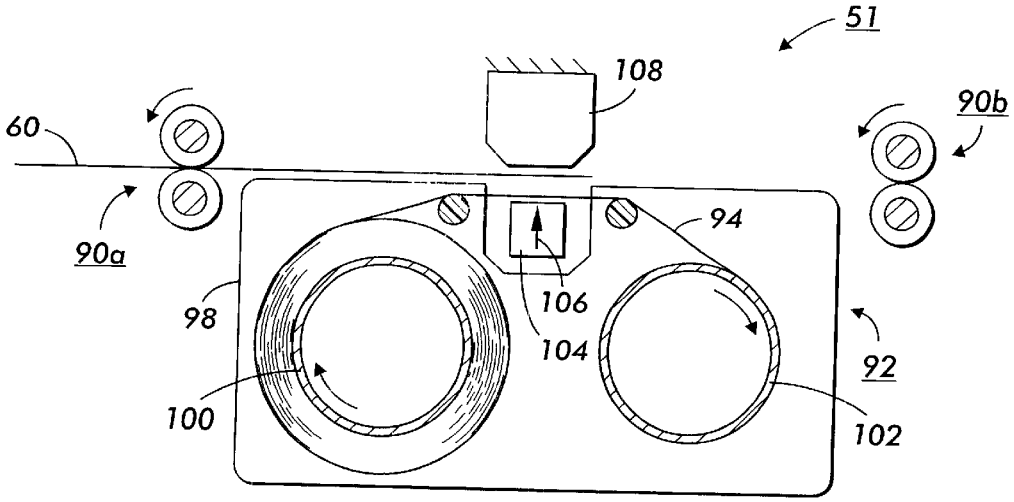
FIG. 6 is a schematic side view of a film depositor.
Figure 7:
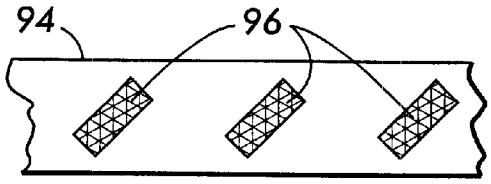
FIG. 7 is a schematic side view of a film dispensing; supply.

Referring also to FIG. 6, there is shown a schematic side view of film depositor 51 according to another embodiment of the present invention and referring also to FIG. 7 there is shown a schematic side view of a film dispensing supply. Film depositor 51 comprises a film dispenser that has a sheet transport system **90*a* that advances a sheet of material 60 in order to have film dispensed at a film location on sheet 60. A film dispensing supply 92 is provided which has a carrier strip 94 and a plurality of film patches 96 located on the carrier strip 94. Film patches 96 are shown as rectangular in shape but may be any number of alternate shapes or sizes suitable for document bonding. Film patches 96 may be film such as toner, thermoplastic resin, polypropylene, polycarbonate, styrene, acrylic, polyethylene, adhesive or other types of film suitable for binding sheets together to form a document set. In an alternate embodiment, carrier strip 94 may be completely covered on one side with a film to be deposited at a film location on sheet 60. Carrier strip 94 may be a flexible polymer strip or any other strip suitable for holding film patches or film. Film dispensing supply 92 further comprises container 98, supply roll 100 and take up roll 102. Sheet 60 is registered or timed relative to patch transfer head 104. When patch transfer head 104 coincides with the desired film location on sheet 60, patch transfer head 104 is advanced against stop 108 in direction 106 and film patch 96 is transferred from carrier strip 94 to sheet 60 at the film location(s). In the alternate embodiment where carrier strip 94 is completely covered on one side with a film, the film deposited on sheet 60 will take the shape of the contacting surface of patch transfer head 104. After patch transfer head 104 retracts, take up roll 102 is advanced such that the next film patch may be dispensed. Sheet 60 is advanced by a sheet transport system 90***b* to be stacked in a bin or a bin sorter prior to a bonding operation. The description above is merely intended to be exemplary. More or less features could also be provided. Such an alternative, for example, could be to provide a mechanism to pick up the film from the carrier and transfer it to the paper in a roller induced motion. Although the film depositor is shown at a fixed position within the copying or printing apparatus, this position is intended to be exemplary and various alternative locations and modifications can be devised by those skilled in the art without departing from the invention. For example, any type of printing apparatus capable of dispensing a film as herein described may be used as film depositor 51.

Figure 8:
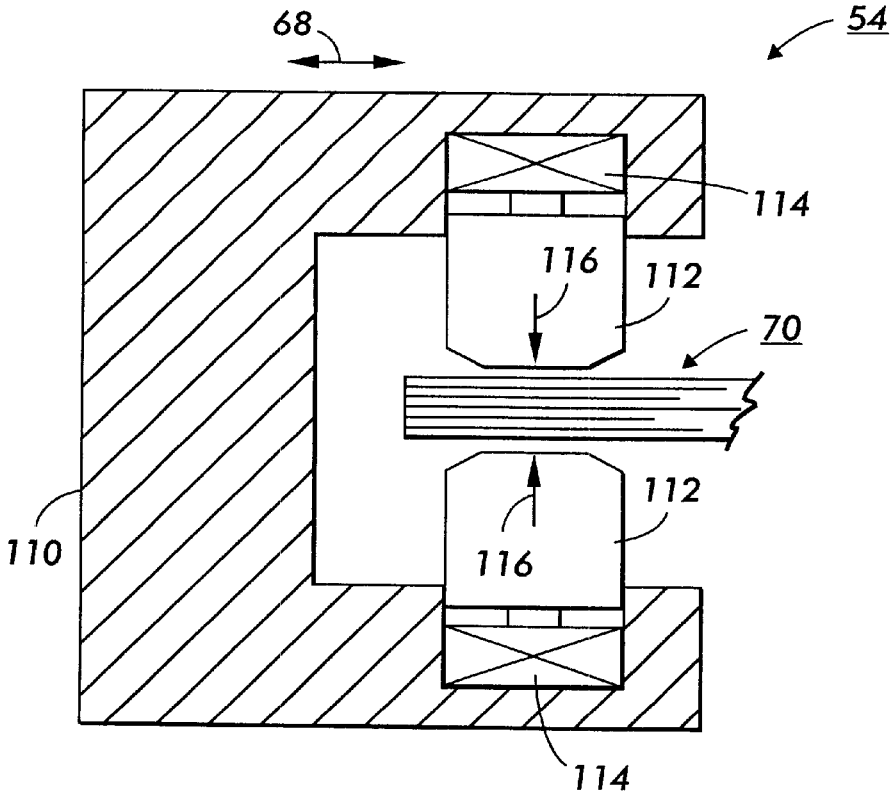
FIG. 8 is a schematic section side view of a bonder.

Referring now to FIG. 8 there is shown a schematic cross-sectional view of document bonder 54 taken along line y—y of FIG. 4. Bonder 54 is shown in the position where document bonder 54 has reciprocated in direction 68 from its usual rest position to its inner operating position where it is able to bracket a completed document set 70 of document sheets. Document bonder 54 comprises a housing 110, heater 112, and clamp actuator 114. Bonder 54, at its inner operating position, is placed such that the position of heater 112 coincides with that of film location 74. Actuator 114 is activated causing heater 112 to apply heat and pressure in direction 116. The heat and pressure activates the film that has been applied at the film location thus forming a bond between the plurality of sheets. Although heater 112 and actuator 114 are shown as a pair, a single heater 112 and actuator 114 may alternately be used with the same result. Actuator 114 may reciprocate heater 112 by any conventional means, such as a gear and rotatable shaft driven by a motor or alternately be moved by a cam attached to a motor and returned to its rest position by means of a spring or alternately be moved by a solenoid and returned to its rest position by means of a spring. Heater 112 may comprise any conventional heater such as a resistance heater, a laser system or an ultrasonic weld head. The description above is merely intended to be exemplary. More or less features could also be provided. For example, bonder 54 could comprise a plurality of heat locations to heat a plurality of film locations and utilize a single actuator 114. As a further example, bonder 54 could only apply pressure in the case that film is used that only requires pressure to bond document sets.

Figure 9A:
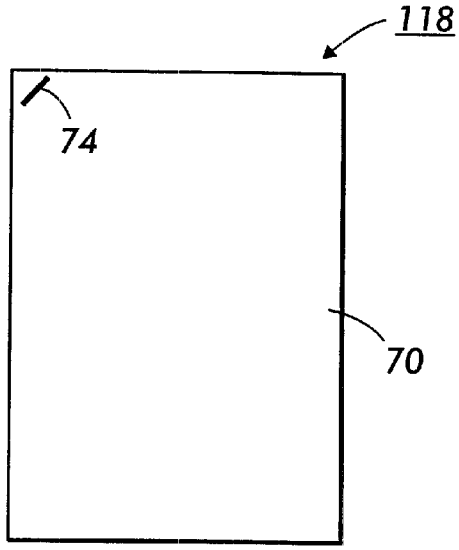
FIGS. 9A through 9D are top views of bound document sets.
Figure 9B:
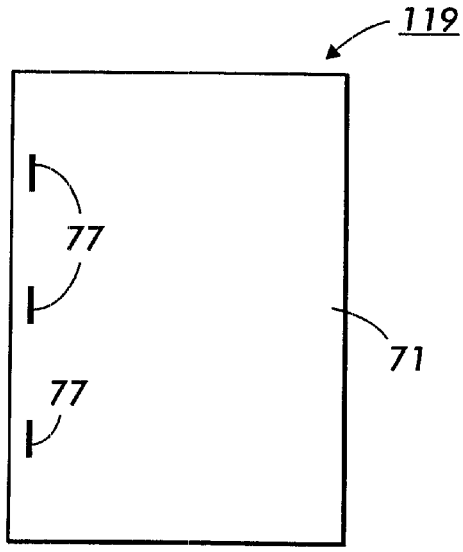
Figure 9C:
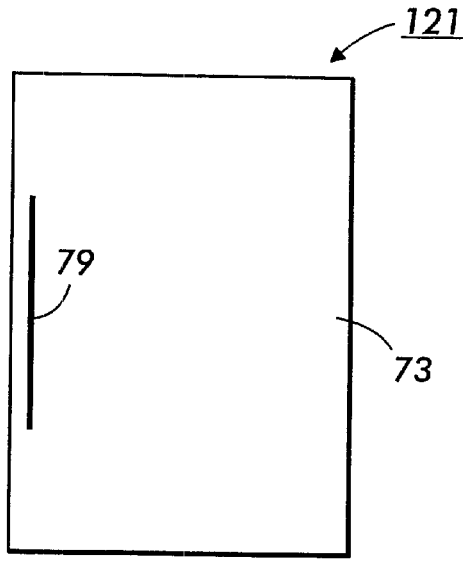
Figure 9D:
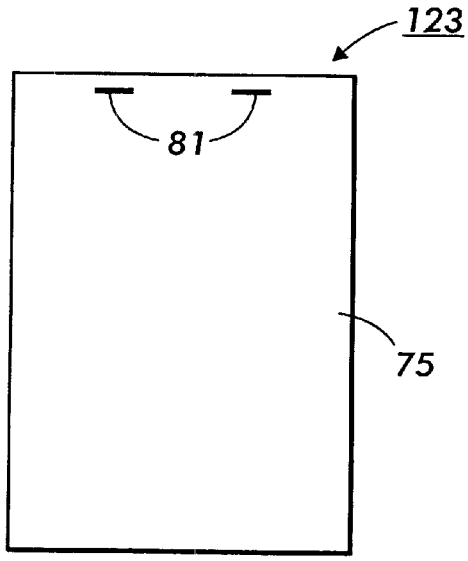

Referring now to FIGS. 9A through 9D there are shown top views of bound document sets showing alternative film locations. The present invention may be applied to bond document sets in any of a number of locations with the shape of the film deposited at a film location in any of a number of shapes. FIGS. 9A–9D are exemplary but application of the invention is not limited to these examples. FIG. 9A shows document set 70 bound at film location 74 at the upper left hand corner of bound document set 118. FIG. 9B shows document set 71 bound at film location 77 at three locations along the left hand side of bound document set 119. FIG. 9C shows document set 73 bound at film location 79 at a single long strip location along the left hand side of bound document set 121. FIG. 9D shows document set 75 bound at film location 81 at two locations along the upper edge of bound document set 123.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A document creating apparatus for creating at least one document set, the document set comprising at least two document sheets, the document creating apparatus comprising:

a transport system for transporting the document sheets;

an image transfer system for transferring images onto sheets of material to form the document sheets; and a film depositor including a carrier strip and a plurality of film patches located on the carrier strip, for depositing a film at a film location on at least one of the document sheets, wherein two of the document sheets placed against each other with the film located directly therebetween are fixedly attached to each other by the film at the film location.

2. The document creating apparatus of claim 1 further comprising a heater for heating the film at the film location.

3. The document creating apparatus of claim 2 wherein the heater comprises an ultrasonic welder.

4. The document creating apparatus of claim 1 wherein the film comprises a thermoplastic resin.

5. The document creating apparatus of claim 1 wherein the film comprises xerographic copying toner.

6. The document creating apparatus of claim 1 wherein the film comprises polypropylene.

7. The document creating apparatus of claim 1 wherein the image transfer system comprises the film depositor.

8. The document creating apparatus of claim 1 wherein the film depositor comprises a printer.

9. The document creating apparatus of claim 1 wherein the image transfer system comprises a toner depositor.

10. The document creating apparatus of claim 1 wherein the image transfer system comprises a printer.

11. A bound document set comprising:

a plurality of document sheets; and a film deposited at a film location on at least one of the document sheets, wherein the film forms a bond at the film location between two of the document sheets, the film being deposited from a carrier strip and a plurality of film patches located on the carrier strip.

12. The bound document set of claim 11 wherein the film comprises a thermoplastic resin.

13. The bound document set of claim 11 wherein the film comprises xerographic copying toner.

14. The bound document set of claim 11 wherein the film comprises polypropylene.

15. The bound document set of claim 11 wherein the film is adapted to be dispensed from a xerographic copying apparatus.

16. The bound document set of claim 11 wherein the film is adapted to be dispensed from a printer.

17. The bound document set of claim 11 wherein the film is adapted to be heated with a heater to melt the film which, when cooled, forms the bond between the two document sheets.

18. The bound document set of claim 11 wherein the film is adapted to be heated with an ultrasonic welder.

19. A film dispensing supply comprising:

a carrier strip; and a plurality of film patches located on the carrier strip;

wherein the film patches can be, at least partially, transferred to a first document sheet to form a bond between the first document sheet and a second document sheet.

20. The film dispensing supply of claim 19 further comprising a roll, wherein the carrier strip is located on the roll.

21. The film dispensing supply of claim 19 further comprising a container, wherein the container retains the carrier strip.

22. The film dispensing supply of claim 19 wherein the film patches comprise a thermoplastic resin.

23. The film dispensing supply of claim 19 wherein the film patches comprise xerographic copying toner.

24. The film dispensing supply of claim 19 wherein the film patches comprise polypropylene.

25. The film dispensing supply of claim 19 wherein the film patches are, at least partially, transferred to the first document sheet with a film patch dispenser.

26. The film dispensing supply of claim 19 wherein the film patches are adapted to be dispensed in a xerographic copier.

27. The film dispensing supply of claim 19 wherein the film patches are adapted to be dispensed in a printer.

28. A method of attaching at least two document sheets to each other comprising the steps of:

depositing a film positioned on a carrier strip as a plurality of film patches located on the carrier strip on a first one of the document sheets at a film location;

placing a second one of the document sheets adjacent to the first document sheet; and bonding the first document sheet to the second document sheet at the film location by the film.

29. The method of claim 28 wherein the step of bonding the first document sheet to the second document sheet at the film location by the film comprises heating the film.

30. The method of claim 28 wherein heating the film occurs at the film location.

31. The method of claim 28 wherein the step of bonding the first document sheet to the second document sheet at the film location by the film comprises ultrasonically heating the film at the film location.

32. The method of claim 28 wherein ultrasonically heating the film occurs at the film location.

33. The method of claim 28 wherein the step of placing a second one of the document sheets adjacent to the first one of the document sheets comprises depositing the second one of the document sheets at a staging location in a xerographic copier.

34. The method of claim 28 wherein the step of placing a second one of the document sheets adjacent to the first one of the document sheets comprises depositing the second one of the document sheets at a staging location in a printer.

35. The method of claim 28 wherein the step of depositing a film on a first one of the document sheets at a film location comprises depositing the film from a xerographic toner cartridge.

36. The method of claim 28 wherein the step of depositing a film on a first one of the document sheets at a film location comprises depositing the film from a printer toner cartridge.

* * * * *